United States Patent [19]

Maddock

[11] 4,098,271

[45] Jul. 4, 1978

[54] OXYGEN SUPPLY SYSTEM AND FLOW INDICATOR

[75] Inventor: Robert W. Maddock, Fountain Valley, Calif.

[73] Assignee: McDonnell Douglas Corporation, Long Beach, Calif.

[21] Appl. No.: 747,228

[22] Filed: Dec. 3, 1976

Related U.S. Application Data

[63] Continuation-in-part of Ser. No. 617,289, Sep. 29, 1975, abandoned.

[51] Int. Cl.[2] ..... A62B 7/14

[52] U.S. Cl. ..... 128/142.3; 128/205; 128/202; 128/146.4

[58] Field of Search ..... 128/203, 202, 205, 185, 128/188, 195, 209, 210, 142 R, 142.2, 142.3, 145.7, 145.8, DIG. 29, 146.4; 114/65, 114 PV, 117 R, DIG. 8, DIG. 9; 73/409

[56] References Cited

U.S. PATENT DOCUMENTS

| | | | |
|---|---|---|---|
| 2,652,830 | 9/1953 | Koza et al. | 128/205 |
| 3,097,642 | 7/1963 | Russell | 128/202 |
| 3,540,443 | 11/1970 | Huddy | 128/202 |
| 3,773,045 | 11/1973 | Boba | 128/202 |
| 3,810,474 | 5/1974 | Cross | 128/349 B |

FOREIGN PATENT DOCUMENTS

| | | | |
|---|---|---|---|
| 828,362 | 2/1960 | United Kingdom | 128/203 |

*Primary Examiner*—Robert W. Michell
*Assistant Examiner*—Henry J. Recla
*Attorney, Agent, or Firm*—John P. Scholl; Walter J. Jason; Donald L. Royer

[57] ABSTRACT

A flow indicator for use in a continuous flow type oxygen apparatus. The flow indicator constructed of a flexible chamber and restrictor to give an immediate visual indication of a minimum acceptable oxygen flow within the system.

6 Claims, 4 Drawing Figures

OXYGEN SUPPLY SYSTEM AND FLOW INDICATOR

CROSS REFERENCE TO RELATION APPLICATION

This application is a continuation-in-part of copending application Ser. No. 617,289, filed 29 Sept. 1975 now abandoned.

BACKGROUND OF THE PRESENT INVENTION

Modern passenger aircraft fly at high altitudes where the outside atmosphere is relatively thin. The passenger compartments in such aircraft are normally pressurized to a comfortable level somewhere below the equivalent of 10,000 feet altitude pressure. When the passenger compartments are depressurized for any reason to a higher altitude pressure, oxygen in some form is usually provided for passenger survival and comfort.

A common type of oxygen system used in modern passenger aircraft is a continuous flow type system which provides a continuous flow of oxygen to the user. Continuous flow type systems have been used for many years and are simple systems of design, cost, weight, and maintenance. Such systems offer reasonable safety for brief periods up to an altitude pressure of approximately 40,000 feet (12,192 meters) and are generally regarded as adequate up to 25,000 feet (7,620 meters) altitude pressure for prolonged protection.

There are several types of continuous flow systems which provide varying degrees of oxygen economy. In some continuous flow systems a flexible reservoir is used to collect oxygen during the breathing cycle, primarily in the exhalation phase. In one of these systems oxygen is diluted with ambient air in a flexible rebreather bag. In another system oxygen is diluted with ambient air in the oxygen mask facepiece. In this latter system, which will be used for illustrative purposes herein, the sequence of inhalation of oxygen and dilution air from the phase dilution mask is usually controlled by the valving to the facepiece.

In the prior art illustrative system oxygen flows into and expands a flexible reservoir. Upon inhalation, the first gas received by the passenger is the oxygen stored in the reservoir and when this is substantially exhausted the balance of the gas supplied on inhalation is primarily ambient cabin air. This system permits a higher efficiency in body utilization of oxygen. The gas reaching the alveolar gas transfer areas of the lung is richer in oxygen. The gas in the trachea and other dead spaces of the lung is richer in dilution air.

When oxygen masks are supplied to passengers following a depressurization, there is sometimes confusion and anxiety on the part of the passengers concerning the availability of the oxygen from the oxygen supply apparatus.

In the illustrative system and in other systems which use a flexible reservoir for oxygen storage and a dilution feature for augmenting the oxygen with ambient air, it is sometimes not immediately apparent if a particular passenger is receiving oxygen to his dispensing device. This difficulty is encountered because the passenger can breathe ambient cabin air which may not contain supplemental oxygen.

In the prior art illustrative system the usual way of determining the flow of oxygen to the reservoir and mask facepiece is to close off the oxygen outlet from the reservoir to the mask facepiece and permit the flexible reservoir to fill. The swelling of the flexible reservoir indicates a positive flow of oxygen. Due to the low rate of oxygen flow in the present system, for example, 0.31 liters/minute (18 in.$^3$/min.), and particularly at lower altitudes, a delay as long as 20 seconds may be encountered at certain pressure altitudes before a positive indication of oxygen flow into the reservoir can be detected. In large aircraft transporting as many as 300 passengers and in certain emergency situations in smaller aircraft, it is desirable to avoid as much delay as possible in the determination of oxygen flow to the passengers. The purpose of the present invention is to provide an immediate and continuous indication of oxygen flow to the oxygen dispensing device without disrupting the flow of oxygen to the passenger.

SUMMARY OF THE PRESENT INVENTION

In accordance with the present invention, a continuous flow oxygen system is provided with a simple inexpensive means of obtaining a positive indication of oxygen flow to the oxygen dispensing device. The inventive concept involves the installation of a small flexible chamber in the oxygen supply line just upstream of the dispensing device and placing a restrictor between the chamber and the dispensing device. The oxygen from the aircraft supply system fills the flexible chamber. The restrictor between the chamber and the dispensing device creates and maintains sufficient pressure in the chamber throughout the period of use so that the chamber remains filled throughout the breathing cycle particularly upon inhalation. The inflated flexible chamber gives an immediate visual indication of positive oxygen flow to the dispensing device.

DETAILED DESCRIPTION OF ILLUSTRATIVE EMBODIMENT

Figure 1:
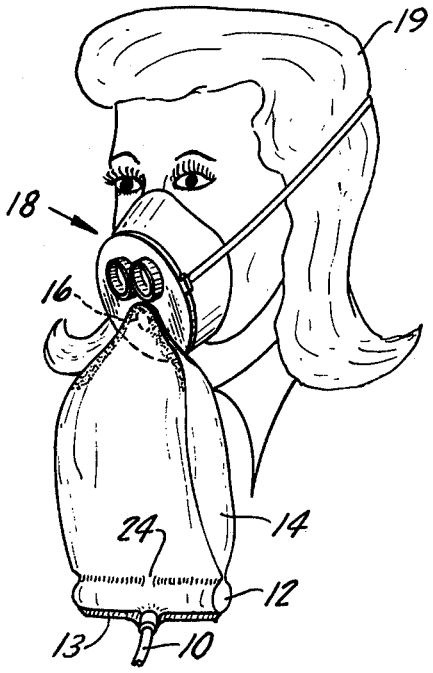
FIG. 1 is a perspective view of a passenger wearing the oxygen mask of the present invention.

Referring to FIG. 1, gaseous oxygen from a source within the aircraft (not shown) enters the system through a supply tube (hose) 10 and passes into an inflatable indicator chamber 12 through an inlet opening 13. Oxygen passes out of the chamber 12 through a restrictor 24 and into a flexible reservoir 14. The reservoir 14 is attached to an oxygen inhalation (inlet) valve 16 (phantomed) on the mask facepiece 18 worn by the passenger 19.

Figure 2:
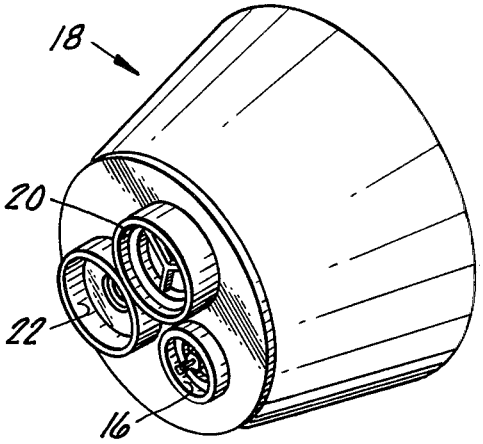
FIG. 2 is a perspective view of the valving and facepiece of a continuous flow type oxygen mask.

The mask facepiece 18 (FIG. 2) has an oxygen inhalation valve 16, air inhalation valve 20, and an exhalation (exhaust) valve 22 mounted therein.

Figure 3:
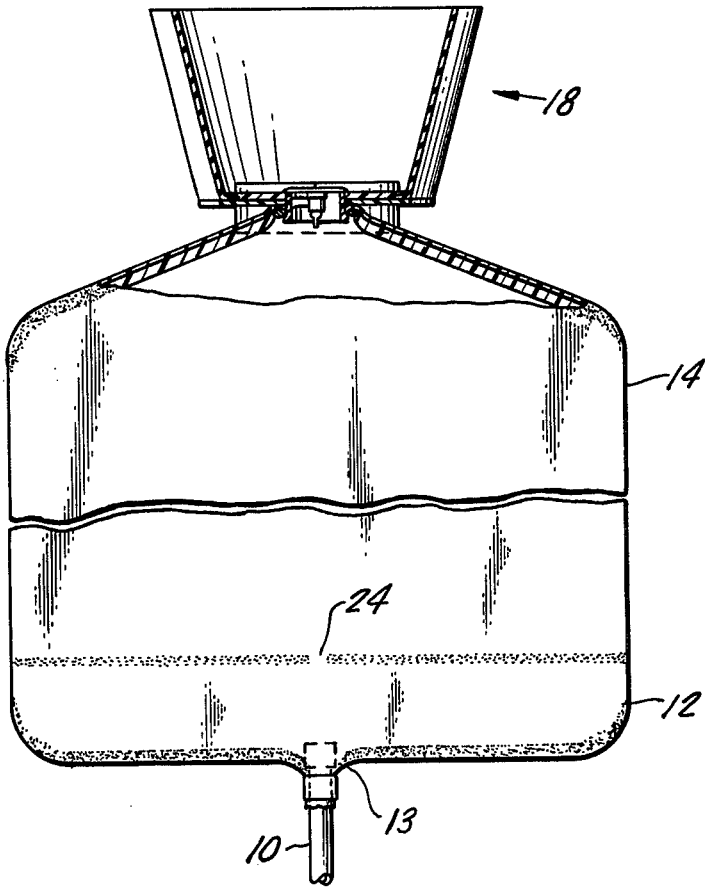
FIG. 3 is a partial sectional view through the continuous flow oxygen supply system of the present invention.

FIG. 3 depicts the preferred embodiment of the inventive flow meter. Oxygen from supply tube 10 enters the indicator chamber 12 through an inlet opening 13. It inflates the indicator chamber and then passes through the restricted opening (restrictor) 24 and into the flexible reservoir 14.

Figure 4:
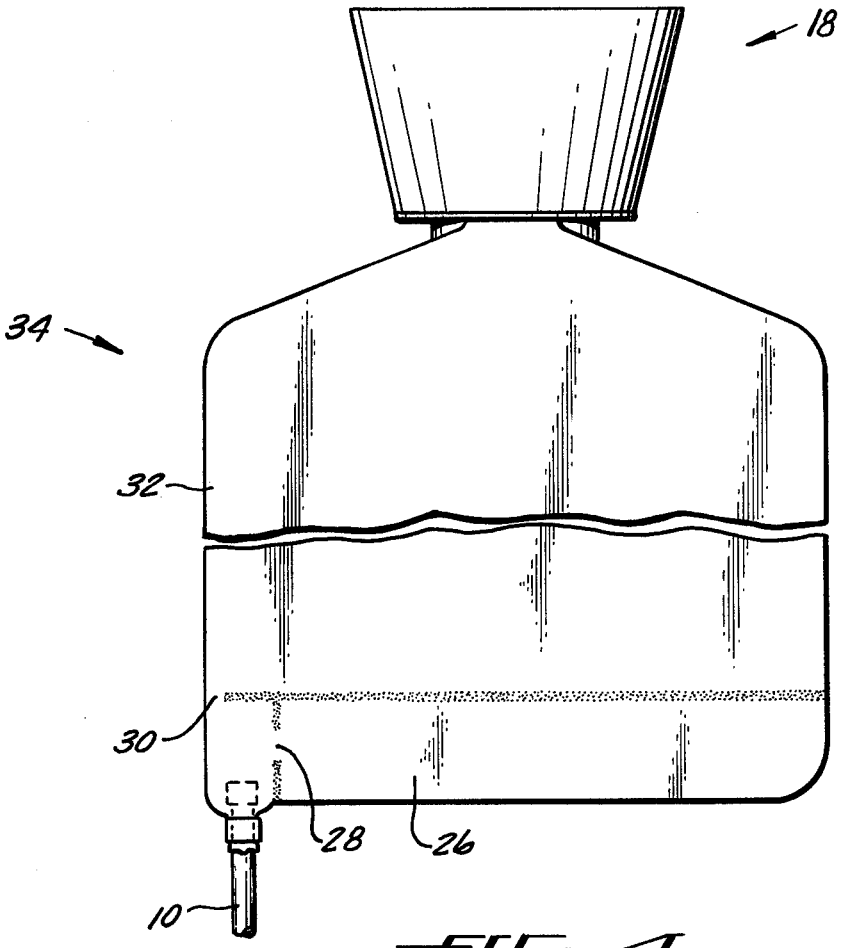
FIG. 4 is an alternative embodiment of a continuous flow oxygen supply system of the present invention.

In FIG. 4 the oxygen supplied by tube 10 is admitted to the inflatable chamber 26 by inlet opening 28. The oxygen from tube 10 also passes through restrictor 30 into a flexible reservoir 32.

The illustrative continuous flow oxygen supply system of FIG. 3 operates according to the following description. Gaseous oxygen from tube 10 enters indicator chamber 12 through inlet opening 13 (FIG. 3) and inflates the chamber 12. The outflow of oxygen from chamber 12 is limited due to restrictor 24. Restrictor 24 is constructed with a limited passageway to create and maintain a pressure in chamber 12 such that the oxygen from the supply tube 10 will keep flexible chamber 12 inflated throughout the breathing cycle when an adequate oxygen flow is being delivered by tube 10.

When the chamber 12 is inflated, the oxygen passes through restrictor 24 into a flexible reservoir 14 which is designed to store (accumulate) oxygen during the breathing cycle, particularly during exhalation.

Upon inspiration, the oxygen inhalation valve 16 (FIG. 2) is designed to open first so that the first gas received by the passenger 19 (FIG. 1) is oxygen from the flexible reservoir 14. When the oxygen in the flexible reservoir 14 is substantially exhausted, the negative pressure in the firepiece 18 rises and the air inhalation valve 20 (FIG. 2) opens and the balance of the gas delivered to the fireplace on inhalation is essentially ambient cabin air.

Upon exhalation, the exhaust valve 22 (FIG. 2) in the fireplace 18 opens due to a positive pressure in the firepiece and permits the gas in the firepiece to pass out into the cabin.

The operation of the alternative illustrative system of FIG. 4 is similar. Oxygen is supplied to the breathing apparatus 34 through tube 10. This oxygen can pass through inlet opening 28 into inflatable chamber 26. The oxygen also goes through restrictor 30 into accumulation reservoir 32. The restrictor 30 creates a pressure upstream (on the supply side) of the restrictor and inflates indicator chamber 26.

The purpose of the restrictor is to create and maintain a localized pressure in the system and to preserve a given volume of oxygen in the indicator chamber as long as there is an adequate flow rate as, for example, 0.31 liters/minutes of oxygen through the supply tube 10. The restrictor also limits the outflow of oxygen to the reservoir upon inspiration by the passenger and causes the air inhalation valve to open admitting ambient air rather than collapsing the indicator chamber.

The inflatable chambers, 12 of FIG. 3, 26 of FIG. 4, may be made of a sheet of flexible material such as polyethylene which is folded over and sealed together to provide an airtight compartment. The chamber can also be made from a tube of flexible material which is sealed on the ends or two sheets of material sealed on all sides to provide a flexible expandable chamber. A conventional method of sealing the sheets of flexible polyethylene material together is by applying heat along the desired seams to melt the polyethylene and form an airtight bond. The seal may also be formed by joining the sheets together with adhesive.

To enhance the visual indication of the indicator chamber 12 (FIG. 3), it can be colored a bright color such as green and can have an appropriate designation such as "GREEN INFLATED — OXYGEN O.K."

The indicator chamber and restrictor of the present invention has been shown and described in combination with an inflatable oxygen reservoir bag; however, the chamber and restrictor can also be used with an oxygen rebreather bag or connected directly to the dispensing device. Other oxygen dispensing devices such as a hood (placed over the passenger's head) can employ a similar device on the supply side.

While certain exemplary embodiments of this invention have been described above and shown in the accompanying drawings, it is to be understood that such embodiments are merely illustrative of, and not restrictive on, the broad invention and that I do not desire to be limited in my invention to the specific constructions or arrangements shown and described, since various other modifications may occur to persons having ordinary skill in the art and it is to be understood that those modifications are to be construed as part of the present invention.

What is claimed is:

1. A continuous flow oxygen apparatus for personal use for distribution of oxygen from a supply comprising:

a sheet of flexible material folded and sealed on the peripheral edge to provide a flexible inflatable indicator chamber;

an entrance opening positioned in the chamber to receive oxygen from said supply and admit oxygen to the interior of the chamber;

a restrictor positioned in the chamber to limit the flow of oxygen from the chamber and create a pressure in the chamber, the restrictor maintaining said chamber in an inflated condition when the desired oxygen flow is present through the chamber; and oxygen dispensing means fluidally connected to said restrictor, said means including an accumulation reservoir fluidically connected to said restrictor to store excess oxygen during the breathing cycle and means for delivering oxygen from said accumulation reservoir to the user.

2. The apparatus of claim 1 wherein the oxygen dispensing means includes an oral-nasal face mask fluidally connected to said reservoir to receive oxygen from said reservoir and deliver oxygen to the user.

3. The apparatus of claim 2 wherein the oral-nasal face mask has an oxygen inlet valve and an air inlet valve, the oxygen inlet valve including biasing means designed to open first upon inspiration to supply oxygen from said supply and the air inlet valve including biasing means to open subsequently to said oxygen inlet valve to supply supplemental ambient air.

4. A continuous flow oxygen apparatus for personal use for distribution of oxygen from a supply comprising:

two layers of flexible material sealed together at their peripheral edges to provide an indicating chamber;

an entrance opening positioned in said indicating chamber, said opening fluidally connected to said supply to admit oxygen to the interior of the indicating chamber;

a restrictor positioned in the indicating chamber for limiting the outflow of oxygen from said indicating chamber, the restrictor maintaining said chamber in an inflated condition when the desired oxygen flow is present through the chamber; and oxygen dispensing means fluidally connected to said restrictor, said means including an accumulation reservoir fluidically connected to said restrictor to store excess oxygen during the breathing cycle and means for delivering oxygen from said accumulation reservoir to the user.

5. The apparatus of claim 4 wherein the oxygen dispensing means includes an oral-nasal face mask fluidally connected to said reservoir to receive oxygen from said reservoir and deliver oxygen to the user.

6. The apparatus of claim 5 wherein the oral-nasal face mask has an oxygen inlet valve and an air inlet valve, the oxygen inlet valve including biasing means designed to open first upon inspiration to supply oxygen from said supply and the air inlet valve including biasing means to open subsequently to said oxygen inlet valve to supply supplemental ambient air.

* * * * *